US007942972B2

(12) United States Patent
Al Nashef et al.

(10) Patent No.: US 7,942,972 B2
(45) Date of Patent: May 17, 2011

(54) METHOD FOR SEPARATING FRUCTOSE AND GLUCOSE

(75) Inventors: Inas M. Al Nashef, Riyadh (SA); Mohamed H. Gaily, Riyadh (SA); Saeed M. Al-Zahrani, Riyadh (SA); Ahmed E. Abasaeed, Riyadh (SA)

(73) Assignee: King Saud University, Riyadh (SA)

( * ) Notice: Subject to any disclaimer, the term of this patent is extended or adjusted under 35 U.S.C. 154(b) by 518 days.

(21) Appl. No.: 12/119,522

(22) Filed: May 13, 2008

(65) Prior Publication Data

US 2009/0283093 A1 Nov. 19, 2009

(51) Int. Cl.
*C13K 1/00* (2006.01)
*C13K 11/00* (2006.01)

(52) U.S. Cl. ..... 127/46.2; 127/46.1

(58) Field of Classification Search ..... 127/46.1, 127/46.2

See application file for complete search history.

(56) References Cited

OTHER PUBLICATIONS

Kirk-Othmer Encylcopedia of Chemical Technology, "Extraction, Liquid-Liquid" (Jun. 2007), pp. 1-62.*

Forsyth et al, "Ionic Liquids-An Overview", Abstract Only, (2004).*

Liu et al, "Room-temperature ionic liquids that dissolve carbohydates in high concentrations", Green Chemistry, (2005) pp. 39-42.*

Youngs et al, "Glucose Solvation by the Ionic Liquid . . .", J. Phys. Chem. B (Nov. 2007) pp. 13765-13774.*

Murugesan et al, "Ionic Liquids in Carbohydrate Chemistry—Current Trends and Future Directions", Current Organic Synthesis, (2005), pp. 437-451.*

Spear et al, "Ionic Liquids: Green Solvents for Carbohydrate Studies", 2002 SPRI Conference Abstracts of Presentations, (Mar. 2002), Poster Abstract.*

* cited by examiner

*Primary Examiner* — David M Brunsman

(74) *Attorney, Agent, or Firm* — Lowe Hauptman Ham & Berner, LLP

(57) ABSTRACT

A process for separating fructose and glucose from mixtures of fructose and glucose from a liquid phase feed solution or a solid mixture containing the fructose and glucose is disclosed. The process implements ionic liquids as selective solvents that dissolve fructose and glucose in large quantities, but at different proportions which are then separated by filtration into a precipitate and a solution of ionic liquid enriched with the other sugar. The process also involves separation of the sugars from the ionic liquid enriched with the other sugar which is accomplished by one of various processes such as extraction with water in a centrifuge or cooling to reduce the solubility of sugar and then filtration. The ionic liquid is then recycled.

20 Claims, 2 Drawing Sheets

1 Dry mixture or sloution of fructose and glucose
2 Pure fructose ar glucose with IL saturated of fructose and glucose
3 Pure solid fructose or glucose
4 IL saturated of fructose and glucose
5 Fresh water
6 IL saturated of fructose and glucose
7 Aqueous solution of sugars
8 Mixture of solid fructose and glucose
9 Water vapor 20 Mixing tank
22 Filter
24 Centrifuge
26 Evaporator

METHOD FOR SEPARATING FRUCTOSE AND GLUCOSE

FIELD OF THE INVENTION

This invention relates to a method for separating fructose and glucose and more particularly to a method for separating fructose and glucose under ambient conditions using one or more ionic liquids.

BACKGROUND FOR THE INVENTION

It is well known that carbohydrates and sugar crops are readily available, inexpensive, and renewable feed stocks for the chemical and food industries. It is also well known that dates are rich in sugars ranging from 65% to 80% on a dry weight basis mostly of inverted form (fructose and glucose in about equal amounts). Further, it has been recognized that only about 10% of the date production is utilized for human consumption while the rest is used as an ingredient in fodder or disposed off.

In many cases, pure sugars are required. For example, the food industry uses large quantities of high fructose corn syrup (HFCS) while pure glucose is used for medical purposes and in the manufacture of pharmaceuticals.

Problems in the production of fructose on a commercial scale have been encountered. For example, since fructose and glucose so closely resemble one another in physical and chemical characteristics most reagents and solvents fail to separate them satisfactorily. Accordingly, early processes fail to produce high purity fructose economically.

There is considerable current interest in the utilization of carbohydrates and sugar crop materials such as dates as readily available, relatively inexpensive, and renewable feed stocks for the chemical and related industries. Examples of the later trend are sugar derived biosurfactants and esters of sugars with fatty acids. The transformation of underivatized carbohydrates is still challenging due to their low solubility in almost any solvent other than water. The few exceptions, such as dimethylsulfoxide and dimethylformamide, have many undesirable characteristics and are not compatible with many intended applications of carbohydrate-derived products.

Chromatography is the method most commonly used for commercial sugar separations. It is currently applied to enrich fructose content in HFCS to separate maltotriose and other compounds from starch hydrolysate, and to separate sucrose and other compounds from molasses. Such a separation is a batch process with relatively low productivity and relatively low yields of the desired product and normally requires expensive installations. Attempts to simulate continuous operation such as the use of a complex valve system or a special column arrangement on a rotating disk that contains the connections are hampered by the complexity of the process and the associated equipment and the high operating cost. Alternative processes have been proposed to accomplish sugar separation, such as zeolite adsorption and reverse osmosis. Processes based on the chemical affinity of sugars include electrodialysis using borates to complex the sugars, ion exchange membranes and liquid membranes. Limited success obtained with these processes reveals the need to develop more efficient processes.

One approach to overcome such problems is disclosed in a U.S. Pat. No. 3,533,839 of Harra et al. As disclosed, a process for separating fructose admixed with glucose comprises treating the mixture thereof with anhydrates absolute ethanol containing anhydrous calcium chloride to extract the fructose as an anhydrous addition compound with calcium chloride and to leave the glucose unextracted. Water is added to the extract to precipitate the fructose as a hydrated addition compound of the calcium chloride and filtering this participate.

Fractionation of sugars is another approach to the separation of fructose and glucose. However, the fractionation of sugar is a relatively difficult and costly task especially when the constituents have very similar characteristics such as glucose and fructose.

It is also known that batch process are commonly used for separation of glucose and fructose contained in a feed solution by inputting such feed solution through a fixed bed of a cation exchange column and then followed by a de-ionized water addition. The separation is carried out through a so-called chromatography, which incorporates a long column packed with a stationary resin. The separation is achieved through a mass transfer phenomenon or mechanism wherein the eluent water is flowing through a part of the stationary resin together with the feed solution in a so-called mass transfer zone. The fructose contained in the feed solution is retained by the resin to a greater degree than glucose.

Chromatographic separation has also been used for the recovery of xylose from hydrolysates of natural materials such as birch wood, corn cobs and cotton seed hulls. The resin employed in the chromatographic separation is a strongly acid cation exchanger, i.e., sulfonated polystyrene cross-linked with divinylbenzene. The use of a strongly acid cation exchanger for separation of monosaccharides e.g. xylose from magnesium sulfite cook liquor is also known. The chromatographic separation has been carried out using a simulated moving bed. However, the separation of certain monosaccharides by using strong acid cation exchange resins is difficult.

Anion exchange resins have also been used for separating fructose from glucose. For example, an anion exchanger in a bisulfite form is used for the separation of sugars. Water is used as an eluent. However, the use of anion exchange resins does not result in a good xylose separation because xylose is overlapped by other sugars. The separation of fructose and glucose by an anion exchanger in a bisulfite or sulfite form is known. For example, poly (4-vinylbenzeneboronic acid) resins in the fractionation and interconversion of carbohydrates has been used. In this process water is used as an eluent. The best yield of fructose was achieved when the pH was high. The resins have been used to displace the pseudo equilibrium established in aqueous alkali between D-glucose, D-fructose and D-mannose to yield D-fructose. Surprisingly, it has been found that when using weakly acid cation exchange resins, an improved chromatographic separation of carbohydrates is obtained. In addition to other features, the order of separation seems to be affected by the hydrophobic/hydrophilic interactions of carbohydrates with the resin and an improved separation of carbohydrates is obtained. Other commonly known features in chromatographic separation of carbohydrates on ion exchange resins include e.g., ion exclusion and size exclusion. If the resin is in the hydrophilic form, the most hydrophobic monosaccharides seem to elute first and the most hydrophilic last. This results in a different elution order than previously found.

U.S. Pat. No. 6,258,176 of Ma teaches a process for producing HFCS, in which a mixed feed solution of glucose and fructose is obtained from the isomerization tower. It is employed as a subsequent unit operation for separating opponents of sugar mixture.

More boldly, this process is used for the continuous separation of the glucose and fructose solution mixtures to retrieve various grades of glucose and fructose solution mixtures and to elevate the concentration level of the separated fraction.

Yet, when this process compares with traditional chromatographic processes, it has its ultimate object to consume less resin inventory and eluent water to gain the ultimate purity and higher concentration of glucose and fructose components with ultimate yield and lower production cost.

Limited successes obtained with the aforementioned processes reveal a need to develop more efficient processes.

Fortunately, a new class of compounds, ionic liquids has emerged in the last ten years that may become a key ally in meeting the twin challenges of efficient and environmentally benign chemical processing. They have the potential to revolutionize the way we think of and use solvents. The reason is, they act like good organic solvents, dissolving both polar and nonpolar species. In many cases, they have been found to perform better than commonly used solvents. In addition, ionic liquids are non-volatile and non-flammable. The wide and readily accessible range of ionic liquids with corresponding variation in physical properties offers the opportunity to design an ionic liquid solvent system optimized for a particular process.

A key feature of ionic liquids is that their physical and chemical properties can be tailored by judicious selection of cation, anion, and substituents. For example, a choice of anions such as halide ($Cl^-$, $Br^-$, $I^-$) nitrate ($NO_3^-$), acetate ($CH_3CO_2^-$) trifluoroacetate ($CF_3CO_2^-$) triflate ($CF_3SO_3^-$) and bis(trifluoromethylsulfonyl) imide $(CF_3SO_2)_2N^-$) can cause dramatic changes in the properties of ionic liquids. The water solubility of the ionic liquid can be controlled by the nature of the alkyl substituent on the cation. Increasing the length of the alkyl chain tends to decrease water solubility by increasing the hydrophobicity of the cation.

It is now believed that the methods for separating fructose and glucose in accordance with the present invention offer a more effective and efficient process for separating the two sugars and for recovering fructose and/or glucose from dates. Further, the methods for separating fructose and glucose from mixtures of the two sugars in accordance with the present invention have been shown to produce fructose or glucose with a purity of more than 99%. In addition, the process in accordance with the present invention has been found to have higher yields and lower production costs, and employs non-flammable and non-volatile and environmentally benign materials.

BRIEF SUMMARY OF THE INVENTION

In essence, the present invention contemplates a method for separating fructose and glucose from mixtures of fructose and glucose at ambient conditions using the differences in their solubility in selected ionic liquids. The ionic liquid is based on the sugar to be recovered as a precipitate. The ionic liquid is selected based on the sugar to be recovered as a precipitate. For example, the method includes the step of providing a first selected ionic liquid and a mixture of fructose and glucose. The method also includes the steps of adding the mixture of fructose and glucose to the first selected ionic liquid and vigorously agitating the mixture in ionic liquid at room temperature until a fructose precipitate is formed leaving a remaining solution. The precipitate is them separated from the remaining solution and the fructose and glucose is extracted from the remaining solution by extraction with water. The fructose and glucose is then recovered from the water by drying under vacuum.

In a preferred embodiment of the invention, a second ionic liquid that is different from the first ionic liquid is provided. In this embodiment of the invention, a mixture of fructose and glucose is mixed with a second selected ionic liquid and vigorously agitated until a glucose precipitate is formed. The precipitate is separated from the remaining solution by filtering or centrifuging and fructose and glucose in the remaining solution is extracted by water.

The invention will now be described in connection with the accompanying drawings.

DESCRIPTION OF THE PREFERRED EMBODIMENTS OF THE INVENTION

A detailed description of the preferred embodiment of the invention will now be described.

The invention relates to a process for the separation of fructose and glucose from a solution of glucose and fructose or a solid mixture of glucose and fructose into glucose and fructose solid precipitate and/or enriched solutions of either glucose or fructose.

The invention is characterized by using ionic liquids as selective solvents that dissolve fructose and glucose in large quantities but at different proportions.

It has been found that the solubility of pure glucose and pure fructose is different in different ionic liquids at ambient conditions. For example, the solubility of glucose in a type A ionic liquid, e.g. 1,3-dimethylimidazolium dimethylphosphate, is 2-6 times higher than that of fructose. This means that a measurable quantity of 20-100 g/100 g ionic liquid of fructose can be separated using the type A ionic liquid. For 1-ethyl-3-methylimidazolium ethylsulfate, type B IL the solubility of glucose and fructose was 90 and 147 g per 100 g of ionic liquid, respectively. This means that about 57 g of glucose can be separated using 100 g of the type B ionic liquid.

Figure 1A:
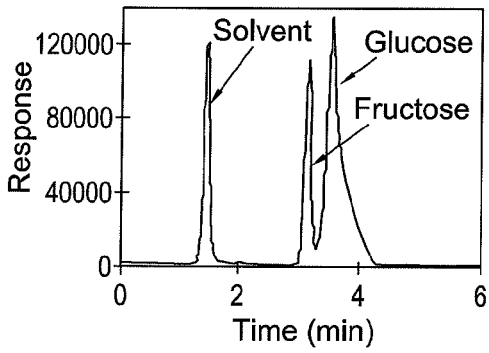
FIG. 1A is a high performance liquid chromatography (HPLC) chromatogram chromatogram for a solution of 1,3-dimethylimidazolium dimethylphosphate, type A, saturated with fructose in the presence of glucose.
Figure 1B:
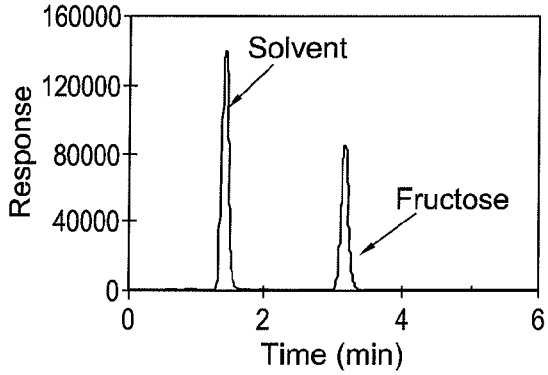
FIG. 1B is an HPLC chromatogram of the precipitate obtained from the solution of FIG. 1A by a process in accordance with a second embodiment of the invention.
Figure 2A:
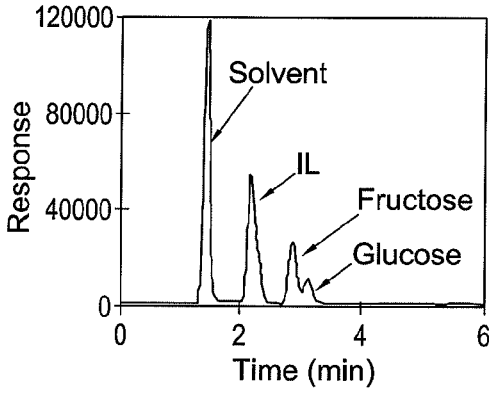
FIG. 2A is an HPLC for a solution of 1-ethyl-3-methylamidazolium ethylsulfate, type B, saturated with glucose in the presence of fructose.
Figure 2B:
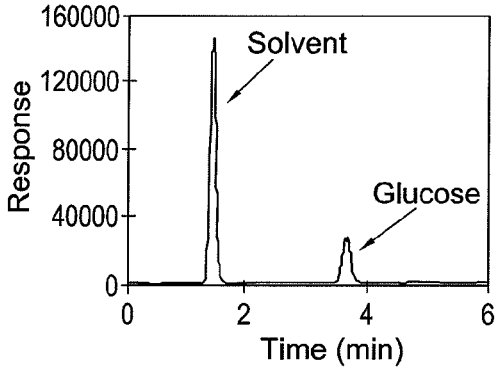
FIG. 2B is an HPLC chromatogram of the precipitate obtained from the solution of FIG. 2A by a process in accordance with the present invention.

In order to show that the difference in solubility can be used for the required separation, a 50% by weight mixture of glucose and fructose similar to that in dates, was added to both type A ionic liquid and type B ionic liquid at room temperature under vigorous mixing until a measurable quantity of precipitate was formed. The solution was separated from the precipitate for both cases by normal filtration. Samples from the precipitates and solutions were then analyzed using high performance liquid chromatography (HPLC) equipped with a special column for the separation of carbohydrates. Samples from the resulting chromatograms for 1,3-dimethylimidazolium dimethylphosphate (type A) and 1-ethyl-3-methylimidazolium ethylsulfate (type B) are shown in FIGS. 1 and 2 respectively. Fructose from type A ionic liquid or glucose from type B ionic liquid with a purity of more than 99% can be separated from the saturated ionic liquid using filtration or centrifuging.

Taking into consideration the close similarity in the chemical structure of glucose and fructose, both being isomers, the aforementioned results show that ionic liquids can be used for the separation of compounds that are very difficult to separate using conventional methods.

In a preferred embodiment of the invention, the feed to the mixing tanks is a mixture of fructose and glucose in a solid phase.

In another preferred embodiment of the invention, the feed to the mixing tank is a solution of fructose and glucose in water, dimethylformamide (DMF), dimethylsulfoxide (DMS), or any combination thereof.

In another embodiment of the invention, a mixture of ILs is used as a selective solvent.

In another embodiment of invention, DMF or DMS is used in a centrifuging device to extract sugars from saturated solutions of sugars in ionic liquids. However, the hazardous properties DMF and DMS should be taken into consideration.

In a further embodiment, the extraction of sugars from the saturated ionic liquids is effected by cooling the saturated solution to a temperature in the range of −10° C. to 10° C. In this case the solubility of sugars will decrease with the decrease in the temperature and the resulting precipitate is separated and recycled into the mixing tank (20). However, the temperature must be higher than the melting point of the ionic liquids.

The invention may also be applied to the separation of glucose and fructose in the presence of a small percentage of sucrose. It was found that the solubility of sucrose in the tested ionic liquids, both type A and type B, is much less than that of fructose and glucose. In this case the dried precipitate will contain a small amount of sucrose and fructose or glucose. The precipitate can be further purified using the method described in the previous embodiment to separate the sucrose from the precipitate.

The ionic liquid that can be used is composed of cation and anion. The cation can be any one of the following: Imidazolium, with di or tri substitution; pyrrolidinium, with di or tri substitution; pyridinium, with di or tri substitution; phosphonium; sulfonium; or ammonium. The anion can be any of the following: Phosphates or substituted phosphates: sulfates or substituted sulfates; acetates or substituted acetates, sulfonates or substituted sulfonates, halide ($Cl^-$, $Br^-$, $I^-$), nitrate ($NO_3^-$), acetate ($CH_2CO_2^-$), trifluoroacetate ($CF_3CO_2^-$), trifilate ($C_3SO_3^-$). The ionic liquid can also be a mixture of any combination of the above, and/or a mixture of ILs.

Figure 3:
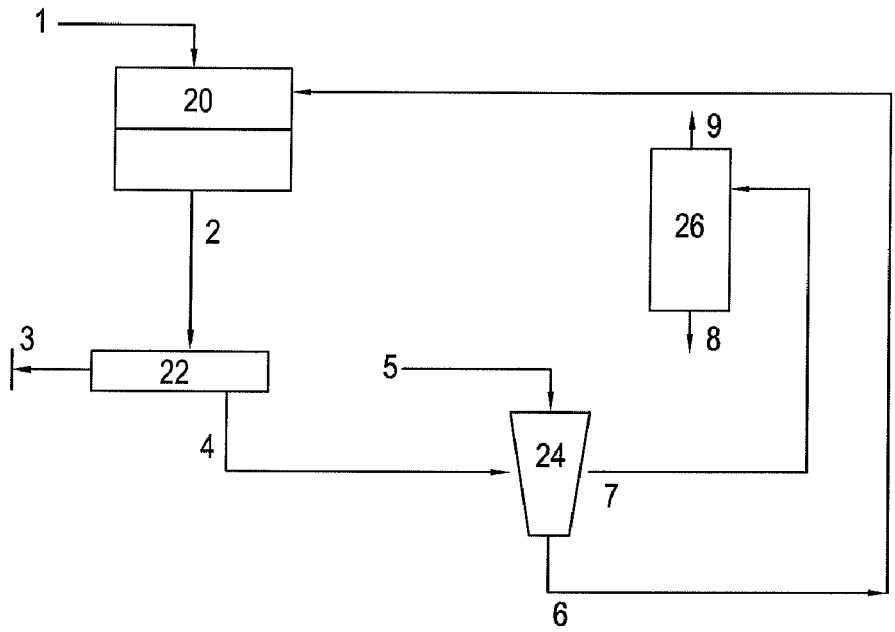
FIG. 3 is a schematic diagram illustrating a process in accordance with a preferred embodiment of the present invention.

FIG. 3 is a schematic illustration of a process in accordance with the present invention wherein a mixture of fructose and glucose is added to a mixing tank (20) together with a make-up stream of IL. In the mixing tank fructose and glucose and the IL are vigorously agitated and then filtered by a filter (22). The pure solid fructose or glucose is removed from the filter (22) and the filtrate or remaining solution is delivered to a centrifuge (24) where water stream is added to extract fructose and glucose from the IL solution. The IL with the remaining fructose and glucose is returned to the mixing tank (20) while the aqueous solution of fructose and glucose coming out from the centrifuge is delivered to an evaporator (26). Dry fructose and glucose mixture, enriched with either fructose or glucose, is then recovered from the evaporator (26).

While the invention has been described in connection with its preferred embodiments, it should be recognized that changes and modifications may be made therein without departing from the scope of the appended claims.

What is claimed is:

1. A method for separating fructose and glucose under ambient conditions comprising the steps of:

providing a first pre-selected ionic liquid or mixture of ionic liquids and a mixture of fructose and glucose;

adding the mixture of fructose and glucose to the ionic liquid and vigorously agitating the liquid and the mixture of fructose and glucose until a precipitate and remaining solution are formed;

separating the precipitate from the remaining solution; and removing the fructose and glucose from the remaining filtrate.

2. A method for separating fructose and glucose under ambient conditions according to claim 1 in which fructose and glucose is extracted from the remaining solution by the addition of water to the remaining solution.

3. A method of separating fructose and glucose under ambient conditions according to claim 2 which includes the steps of removing the fructose and glucose from the filtrate and water by drying under vacuum.

4. A method for separating fructose and glucose under ambient conditions according to claim 3 in which the first pre-selected ionic liquid is mono or poly alkyl-substituted imidazolium alkyl-substituted sulfate or alkyl dicynamide and in which fructose is enriched in the remaining solution and glucose is recovered from the precipitate.

5. A method for separating fructose and glucose under ambient conditions according to claim 4 which includes the step of recycling the ionic liquid.

6. A method for separating fructose and glucose under ambient conditions according to claim 3 in which the first pre-selected ionic liquid is mono or poly alkyl substituted imidazolium alkyl phosphate or alkyl acetate and in which glucose is enriched in the remaining solution and fructose is recovered from the precipitate.

7. A method of separating fructose and glucose under ambient conditions according to claim 6 which includes the step of recycling the ionic liquid.

8. A method for separating fructose and glucose under ambient conditions according to claim 3 which includes the step of recycling the ionic liquid.

9. A method for separating fructose and glucose under ambient conditions according to claim 3 in which the mixture of fructose and glucose is high fructose corn syrup.

10. A method for separating fructose and glucose under ambient conditions according to claim 9 in which the ionic liquid is alkyl imidazolium alkyl phosphate or alkyl acetate or a mixture of the two, and in which the ionic liquid is recycled.

11. A method for separating fructose and/or glucose from a mixture of fructose and glucose according to claim 3 which includes the step of removing sucrose.

12. A method for separating fructose and glucose under ambient conditions comprising the steps of:

a. Providing a first pre-selected ionic liquid or mixture of ionic liquids and a mixture of fructose and glucose;

b. Adding the mixture of fructose and glucose to the selected ionic liquid and vigorously agitating the ionic liquid and the mixture of fructose and glucose until a precipitate and a remaining solution are formed;

c. Separating the precipitate and remaining solution;

d. Removing the fructose and glucose from the remaining solution;

e. Drying fructose or glucose from step d under vacuum; and f. Subjecting the liquid after the removal of fructose or glucose in step d to steps b, c, d and e.

13. A method for recovering fructose and/or glucose from dates comprising the steps of:

Providing a mass of dates and an ionic liquid consisting of alkyl substituted imidazolium alkyl sulfate or alkyl dicynamide or alkyl substituted imidazolium alkyl phosphate or alkyl acetate;

Selecting one of the ionic liquids and dissolving the dates in the selected ionic liquid;

Vigorously agitating the selected ionic liquid and dates until a precipitate is formed with a remaining solutions;

Separating the remaining precipitate and the remaining solution; and removing the fructose or glucose from the remaining solution.

14. A method for recovering fructose and/or glucose from dates according to claim 13 in which fructose or glucose is extracted from the remaining solution.

15. A method for recovering fructose and/or glucose from dates according to claim 14 in which the precipitate and remaining solution are separated by filtration.

16. A method for recovering fructose and/or glucose from dates according to claim 14 in which the precipitate and remaining solution are separated by centrifuging.

17. A method for recovering fructose and/or glucose from dates according to claim 14 in which the fructose or glucose is extracted from the remaining solution by the addition of water.

18. A method for recovering fructose and/or glucose from dates according to claim 17 which includes the step of removing the water by drying under a vacuum.

19. A method for recovering fructose and/or glucose from dates according to claim 13 in which the dates are dried and broken up into pieces prior to being dissolved in the ionic liquid.

20. A method for recovering fructose and/or glucose from dates according to claim 13 in which the dates are essentially extracted by water before mixing with an ionic liquid.

* * * * *